United States Patent [19]

Dykmans

[11] Patent Number: 4,884,747

[45] Date of Patent: Dec. 5, 1989

[54] RIPPLE-FREE FLOW, ACCURATE MIX, AND AUTOMATED SPRAY SYSTEM

[76] Inventor: Max J. Dykmans, 1214 Pioneer Way, El Cajon, Calif. 92022-0696

[21] Appl. No.: 50,317

[22] Filed: May 14, 1987

[51] Int. Cl.[4] ..... B05B 7/04; B05B 3/00; F04B 35/00

[52] U.S. Cl. ..... 239/61; 239/73; 239/398; 239/407; 239/752; 417/342; 417/345; 417/346; 118/323; 118/712; 427/426

[58] Field of Search ..... 417/342, 344, 345, 346, 417/347; 118/688, 712, 300, 306, 317, 323; 427/426; 239/61, 73, 75, 722, 332, 177, 140,142, 10, 398, 407, 752

[56] References Cited

U.S. PATENT DOCUMENTS

| | | | |
|---|---|---|---|
| 3,409,222 | 11/1968 | Gelin | 239/142 |
| 3,765,605 | 10/1973 | Gusmer et al. | 239/61 |
| 3,801,009 | 4/1974 | Marshall, III | 239/9 |
| 3,914,077 | 10/1975 | Lodes | 239/752 |
| 4,493,286 | 1/1985 | Carson | 118/688 |
| 4,593,360 | 6/1986 | Cocks | 239/416 |
| 4,628,861 | 12/1986 | Mitchell | 118/300 |

FOREIGN PATENT DOCUMENTS

| | | | |
|---|---|---|---|
| 3329296 | 2/1985 | Fed. Rep. of Germany | 239/61 |
| 2490745 | 3/1982 | France | 239/527 |
| 0596291 | 3/1978 | U.S.S.R. | 239/332 |

*Primary Examiner*—Andres Kashnikow
*Assistant Examiner*—Christopher G. Trainor
*Attorney, Agent, or Firm*—Lyon & Lyon

[57] ABSTRACT

An apparatus for the construction of improved tank structures employing a pump metering and delivery system which accurately meters, mixes and evenly sprays composite materials to form the walls of tanks or containment vessels. Such systems have specific application to the construction of walls of prestressed tanks formed by inflating a membrane and applying rigidifying material outwardly of the membrane and then prestressing the walls by circumferentially wrapping prestressing material around the same. Promoters, catalyst, and other chemicals are used to create composite walls, each feeding into individual pump systems comprised of at least two hydraulic cylinders connected to supply cylinders which are coordinated so that their strokes are controlled to arrive at a desired flow. The flow is then channeled through a mixer which mixes the material for spraying through a nozzle. The flow from the nozzle can also be intermixed with chopped glass from a chopper system or with granular materials. Both the glass chopper system or the granular material feed system and the movement of the hydraulic system is controlled by servo units which can be controlled to the desired volume of spray. The spray unit is moveably located on the tower and can ride around the tank as well as position itself vertically allowing for the continuous spraying of the walls of the tank. A computer can be used to synchronize the pumping rates, the chopper rates and for other considerations. The computer can also be used to monitor and store the output of the system.

20 Claims, 4 Drawing Sheets

FIG. 1.
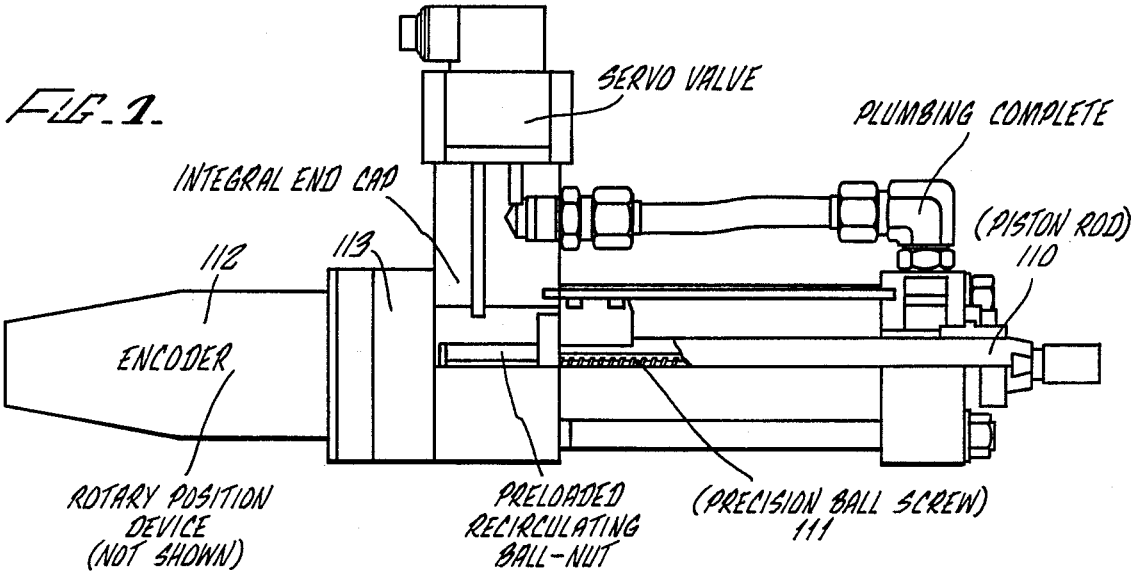
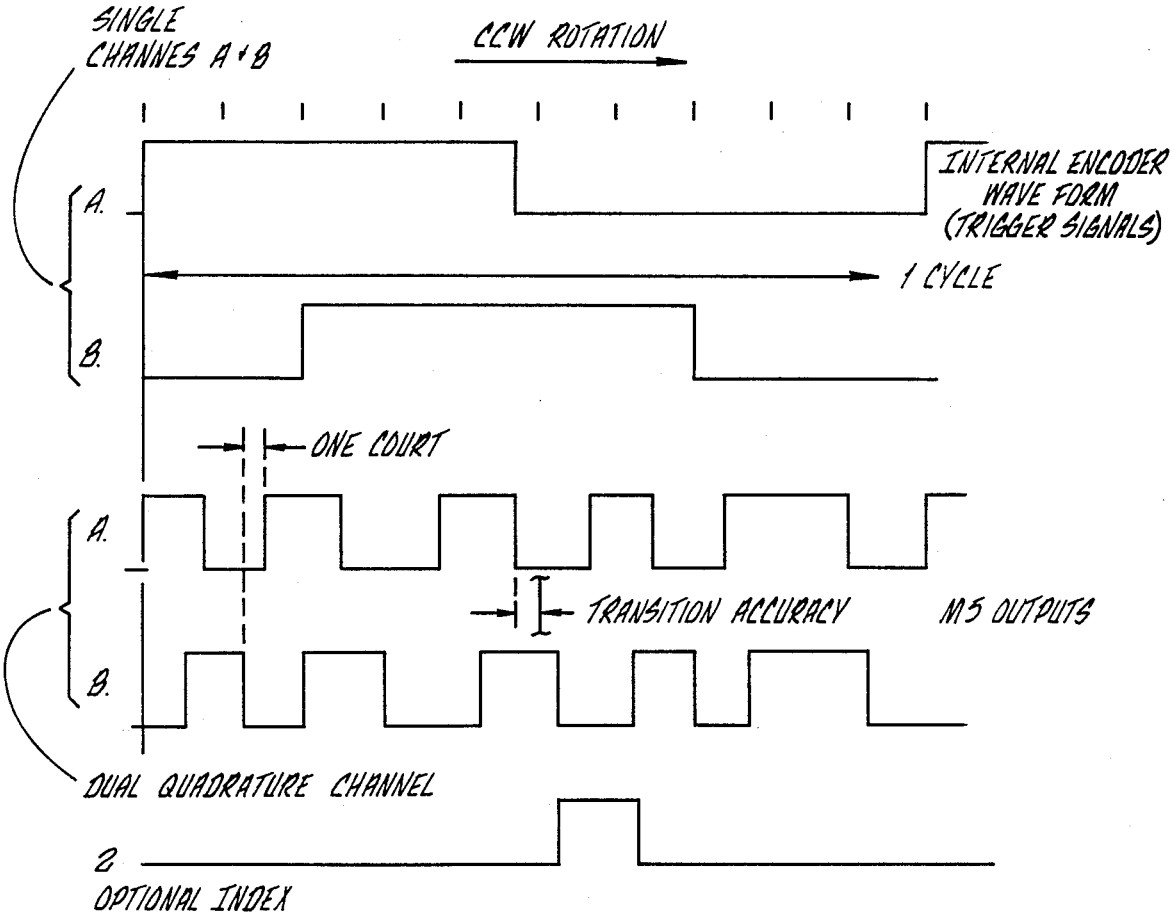
FIG. 6.

RIPPLE-FREE FLOW, ACCURATE MIX, AND AUTOMATED SPRAY SYSTEM

BACKGROUND OF THE INVENTION

This application is related to application Ser. No. 06/915,269 filed 10/3/86 by the same inventor MAX J. DYKMANS, and entitled "A METHOD AND APPARATUS FOR CONSTRUCTING CIRCUMFERENTIALLY WRAPPED PRESTRESSED STRUCTURE UTILIZING A MEMBRANE" which in turn is a continuation-in-part of application Ser. No. 559,911 filed on 12/9/83, now U.S. Pat. No. 4,776,145 issued on Oct. 11, 1988by the same inventor MAX J. DYKMANS, and entitled "MULTI-PURPOSE DOME STRUCTURE AND CONSTRUCTION THEREOF".

The field of the invention is generally circumferentially wrapped prestressed structures, and their construction, which structures can be used to contain liquids, solids or gases. The invention is particularly useful in the construction of domed prestressed structures such as those set forth in the above applications which are incorporated herein by reference.

The background which gave rise to the subject invention is also set forth in the above applications. Briefly summarizing, there has been a need of reinforced plastic, fiberglass or resin sandwich composite structures of the type set forth in the above two applications where the walls are formed by inflating a membrane, applying one or more layers of rigidifying material outwardly of said membrane, prestressing the walls by circumferentially wrapping prestressing material around the rigidifying material and membrane, and then placing a protective coating or rigidifying material or other material outside of the circumferential wrapping. A reason why large fiberglass tanks have not been popular in the past is the difficulty of constructing these tanks under field conditions. The tanks are often built in deserts, or mountain tops and away from the pristine and controlled conditions of the laboratory. Resins are commonly delivered with promoters for a certain fixed temperature, normally room temperature. However, in the field, temperature will vary substantially. Certainly, variations from 32° to 120° F. may be expected. These conditions mean that the percent additives for promoting the resin and the percent of catalyst for the chemical reaction, which will vary widely under those temperature variations, need to be adjusted constantly for existing air temperatures. Considering that some of these percentages are very small compared to the volume of resin, accurate metering and mixing is required which presents a major hurdle to on-site construction of fiberglass tanks. Current metering systems are not believed to be accurate enough under these conditions.

Accordingly, there has been a need for the invention claimed herein—a system which will accurately meter, mix and evenly spray composite materials to make the walls of such tanks or containment vessels.

SUMMARY OF INVENTION

The present invention is directed to improved tanks and structures and the processes and apparatus for their construction.

In the first aspect of the present invention, a metering, mixing and pumping system is disclosed which is used to apply one or more layers of rigidifying material to form the walls of such improved tank structures. While the system has broad applications, it is used in this instance to spray rigidifying material outwardly of an inflated membrane which is thereafter circumferentially prestressed once the rigidifying material has set.

Accordingly, in another aspect of the invention, the system is used in conjunction with an automated delivery system which, in the best mode, comprises a rotatable tower structure with a mechanism to raise or lower the pump delivery system so that the totality of the tank walls can be sprayed with rigidifying material. The system meters a variety of chemicals, typically comprising resins, catalysts, and promoters, accurately mixes them, and then delivers them via a spray nozzle to form the walls of the tank. A stream of chopped filaments or small aggregates is sometimes superimposed and intermixed in the spray to add strength. A computer monitors the conditions of delivery including temperature, mix ratios, pumping speed and movement of the spray unit.

The spray unit comprises a series of parallel pump systems coordinated so that the flow remains constant throughout their operating range.

BRIEF DESCRIPTION OF THE DRAWINGS

FIG. 6 shows a typical waveform pattern of an encoder.

FIG. 7 shows a precision ball screw, attached to the encoder, inside the piston rod.

DETAILED DESCRIPTION OF PREFERRED EMBODIMENTS

In the best mode, reservoirs of resin, two or three types of promoters, styrene, and one or two types of catalysts each feed into six individual pump systems each comprised of two hydraulic cylinders and two supply cylinders coordinated so that their strokes are synchronized to arrive at a continuous flow. The flow from each system is then channeled to a mixer which exhausts the materials through a nozzle. The flow from the nozzle may be intermixed with the flow from a glass chopper system. Both the glass chopper system and the movement of the hydraulic systems is controlled by a servo system which can be synchronized to the desired volume of spray.

The spray unit is moveably located on a tower which can ride around the tank as well as move vertically up and down, thus allowing for a continuous spraying of the walls of the tank. A computer can be used to synchronize the pumping rates, the chopper rate and other considerations. The same computer can also be used to monitor, and store the output of such instruments as encoders, flow meters and temperature sensors. A number of commercially available programmable controllers, monitors and recorders permit the monitoring and control of such requirements.

Figure 1:
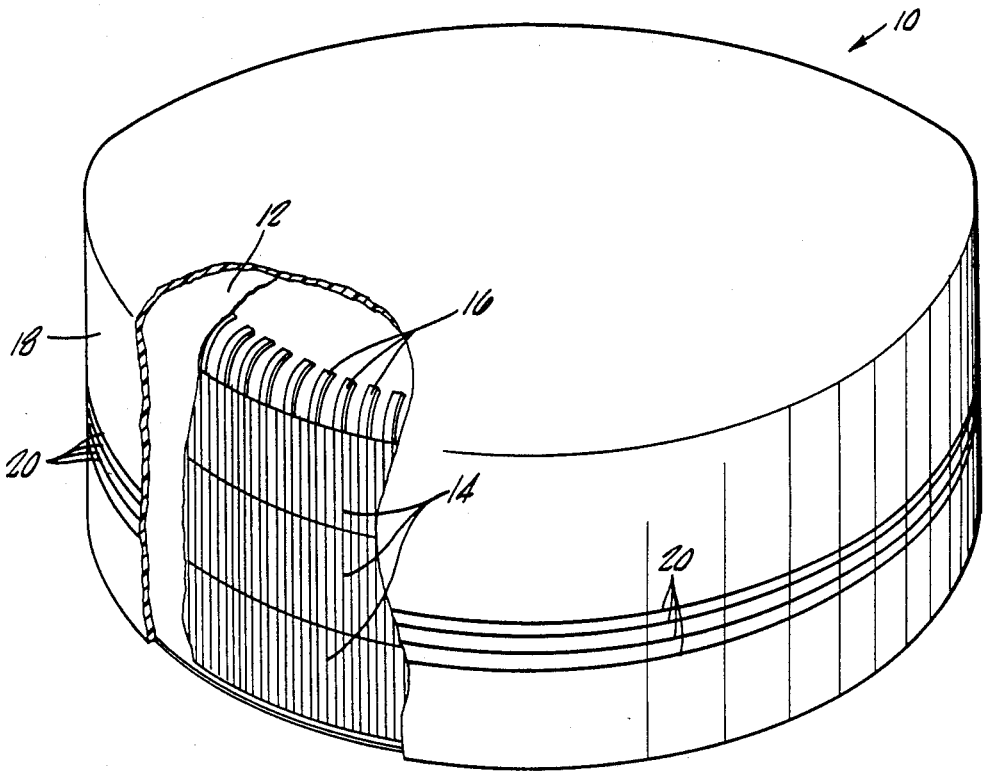
FIG. 1 shows the elevation view of a circular composite structure, containment vessel, or tank under construction. The composite walls of the tank are cut away to reveal the outside fiberglass/resin/laminate (FRP) structure which is deposited utilizing the subject spray unit. The formwork, inflated membrane and circumferential prestressing is also shown.

Turning now to the drawings, FIG. 1 shows the basic tank configuration, with a dome roof, in the process of being constructed. A cut-out of the tank during construction illustrates how the subject invention is used in the best mode.

Figure 2:
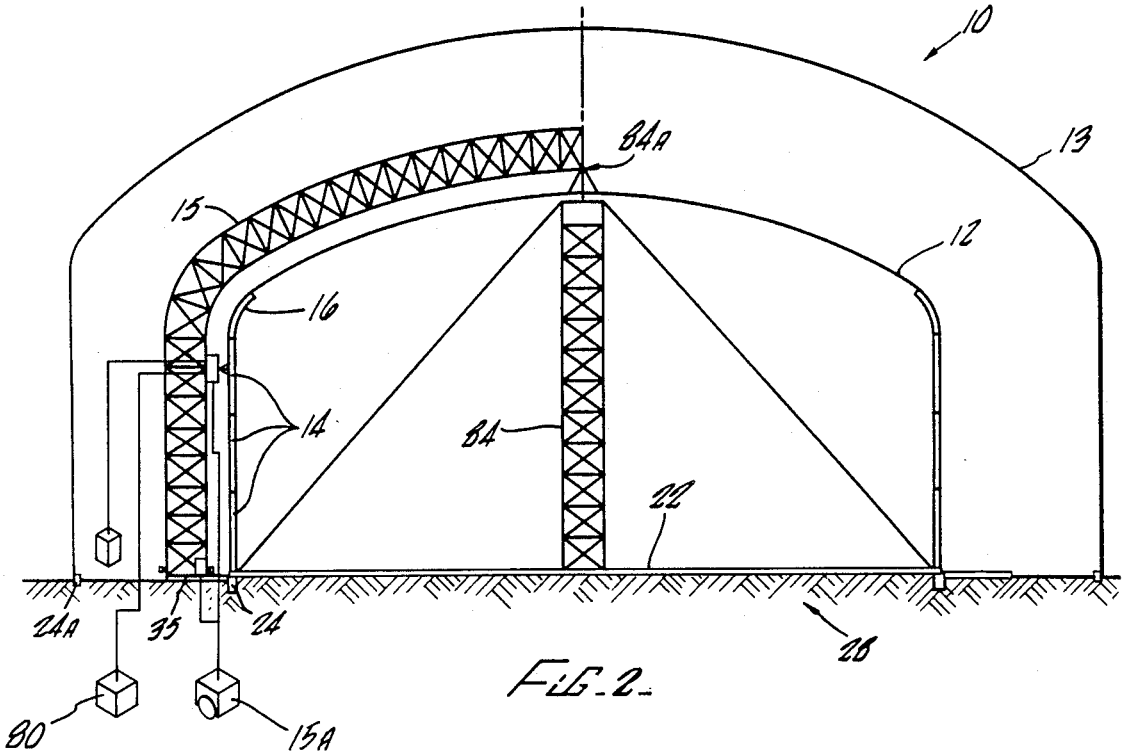
FIG. 2 shows a cross-sectional view of the tank illustrating the inner and outer membrane, and the tower structure which can revolve around the tank footing and which controls the positioning of the spray unit.

With reference to FIG. 2, the construction sequence is briefly set forth as follows: First, the inner base, 24 the outer base 24A and drive pad 35 for the machinery to ride on is constructed. The inner inflatable membrane 12 and the outer membrane 13 are then anchored to their base and inflated. If required, wall forms 14 and 16 are assembled within the inflated membrane for support. Thereafter, rigidifying material (RM) is applied to the outside of the membrane forming composite wall 18. (FIG. 1) This composite wall is constructed by spraying on the inflated membrane, fiber reinforced plastic (FRP) and polymer mortar (pm) and or sand-resin (SR) layers in varying proportions depending on the type of laminate structure desired. After the FRP has set, the walls are then prestressed using steel wire 20 in FIG. 1 and the apparatus shown in part, in FIG. 2.

The apparatus shown in FIG. 2 is one means of spraying the rigidifying material on the membrane to form the walls of the laminate structure desired. A stationary tower 84 is constructed and stabilized by tie wires providing a fulcrum 84*a* around which rotating tower 15 can rotate. The revolving tower in this case is mounted on wheels 15A and rides around the tank on drive pad 35. In the preferred embodiment, the rotating tower is also used for the prestressing operations to carry the wire-winding equipment such as that set forth in U.S. Pat. Nos. 3,372,596; 4,302,978; 3,869,088; 3,504,474; 3,666,189; 3,892,367 and 3,666,190 used to wrap the prestressing wire around the tank. The spray unit 11 is able to move vertically on the revolving tower via a servo-control system. Thus, the unit can move around the circumference of the tank and upward in a spiral. Layer after layer of composite material can thus be sprayed forming the walls. Resin, styrene, promoter and catalyst reservoirs are also contained on or adjacent to the tower, feeding the chemicals to the pumping mixing and spraying apparatus on spray unit 11. A computer can continuously compute the nozzle travel speed and the various mix ratios for optimal mixing of the composite for any electronically sensed air temperature.

For purposes of this disclosure, rigidifying material is defined as a variety of materials including solid fiber reinforced plastic (FRP) or an inner or outer layer of fiber reinforced plastic combination, with the middle layer being resin, sand resin or other material. The fiber reinforced plastic may be reinforced additionally by multi-directional short fibers made of glass, steel, synthetics, organics or asbestos. The rigidifying material typically also can contain resin such as polyester resin, halogenated polyester, Bisphenol-A Fumarate resin, vinyl ester, isopthalic resin or epoxy resin and the like. Phosphoric acid coated hot-dipped galvanized or stainless steel fibers can also be used.

Figure 3:
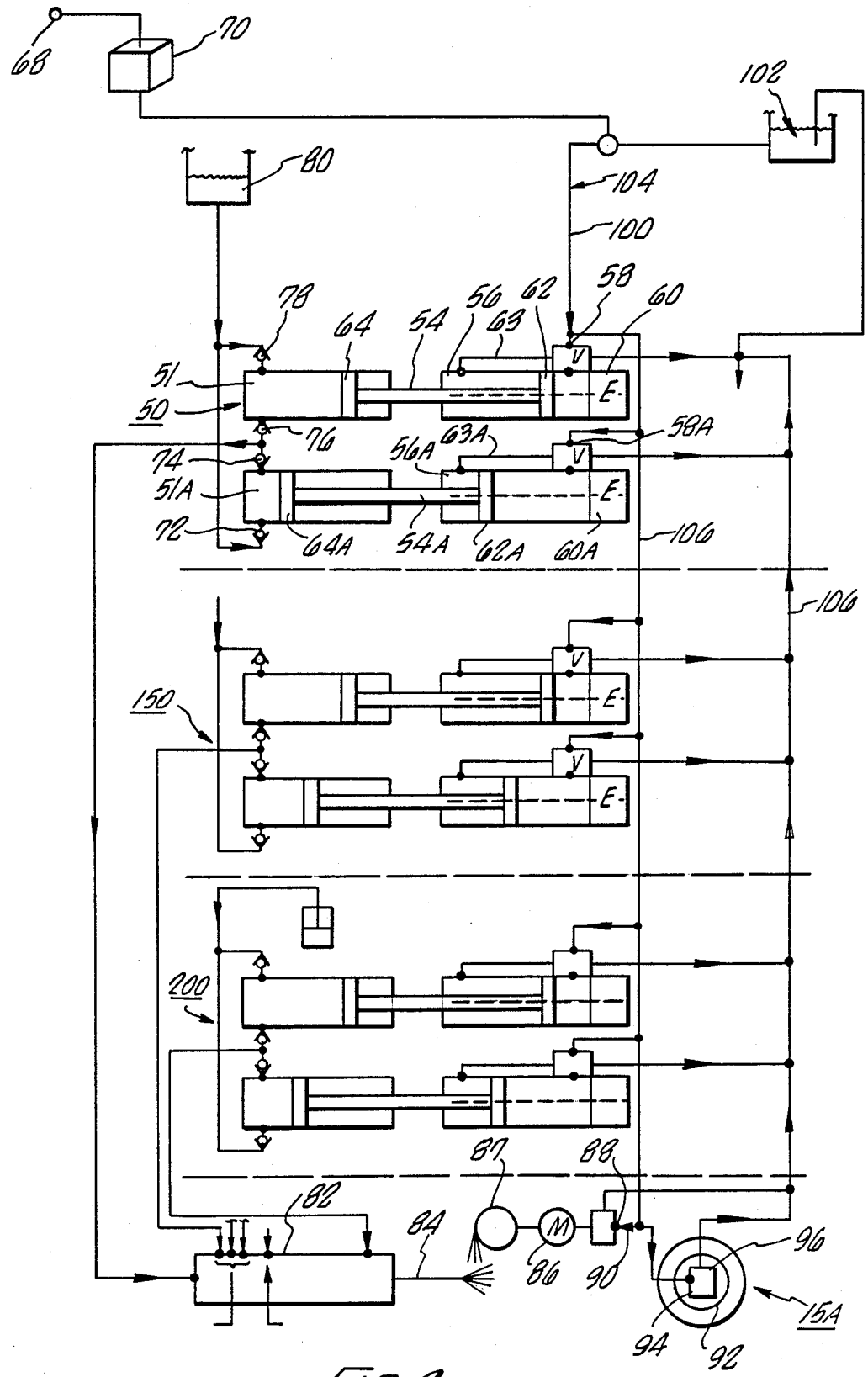
FIG. 3 shows a schematic of the hydraulic pump system of the subject invention.

FIG. 3 illustrates a schematic of the spray unit complete with the hydraulic circuits. As emphasized earlier, a ripple-free flow and accurate mix system is of great importance when promoters, catalysts and styrene have to be added to a resin in continuously varying and accurately metered quantities for fiberglass (FRP) or polymer mortar (PM) applications.

For example, the addition of styrene may vary between 0.25% and 25% of the resin quantity. The quantities of promoters and catalyst, compared to the quantity of resin, are usually very small. They may range from 0.01% to 1.5% of the resin quantity depending on the air temperature under which FRP and PM have to be manufactured. Slight variations in quantities of promoters and catalyst can cause great variations in the quality and curing time of the FRP and PM product which can lead to substantial problems.

The problems are solved by utilizing a series of dual piston systems each utilizing a first hydraulic cylinder driving a first supply piston and a second hydraulic cylinder driving a second supply piston each of which is coordinated so that the combined volume of material pumped by the actions of both supply pistons is constant over time. What is arrived at is substantially ripple free continuous flow. Focusing on FIG. 3, three representative dual piston systems 50, 150 and 200 are shown reflecting the best mode where resin, promoter, styrene and catalyst are mixed together. At least one dual piston system per chemical would be utilized. All hydraulic cylinders of such dual piston systems are connected to a central pressurized input supply line 100 fed from a reservoir 102 and pressurized by a pump unit 104. All pump units are also connected to a common return line 106 leading to a reservoir 102. Focusing first to the first representative dual piston system 50, two supply plungers 64 and 64A are shown connected through connecting rods 54 and 54A to two hydraulic plungers 62 and 62A. Plungers 62 and 62A move within hydraulic cylinders 56 and 56A and are connected by connecting rods 54 and 54a to plungers 64 and 64*a* in supply cylinders 51 and 51A.

Figure 5:
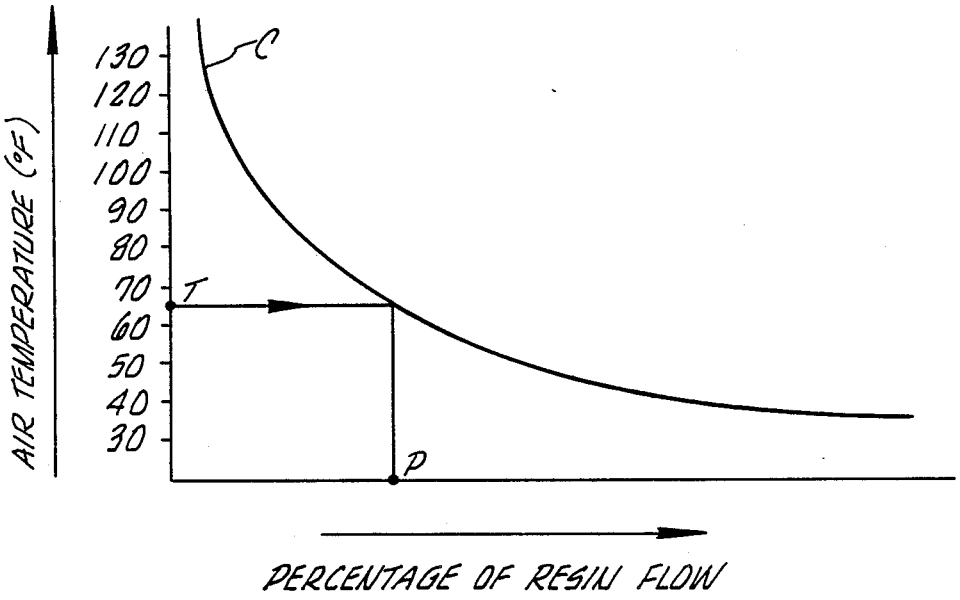
FIG. 5 is a graph illustrative of the relationship of the percentage of resin flow for styrene, promoters or catalysts as a function of ambient air temperature.

On each cylinder 56 and 56A is mounted a servo valve 58 and 58A and an incremental optical encoder 60 and 60A. Essentially, the encoder provides closed-loop feedback information with the computer controller permitting the servo valve to be opened or closed depending on the signal output difference between the desired output setting in the computer and the feedback signal from the encoder. If, for example, the output signal from the computer is made positive and the feedback signal from the encoder is made negative, a simple summing of the two signals will offer a signal difference that is either positive or negative. If the signal is positive, then the servo-valve needs to be opened some more, if the signal difference is negative then the servo valve needs to be closed a little, or, in a drastic change, the oil flow needs to be stopped or reversed through lines 63 and 63A. The magnitude of the signal difference, either positive or negative, will determine how much the servo valve is to be opened, closed or reversed. For each of the promoter, catalyst and styrene additions, that computer output is based on the relationship of temperature versus "percentage of resin flow'-'such as illustrated in FIG. 5 which needs to be developed for each of the promoters, catalysts and resin additions for any given resin. This curve is representative and reflects the fact that the air temperature between the inner and outer membranes 12 and 13 is continuously monitored and fed into the computer which instantly determines and regulates the computer output signal and thus the velocity of the plungers and the flow rate.

The first item to be considered in the best mode operation of the subject invention is the desired resin flow which determines the production rate of the fiber-reinforced plastic or polymer mortar. That output is a function of the piston velocity (e.g., inches per second). Since the piston diameter is typically fixed, there is a direct relationship between the resin flow rate and piston velocity. The velocity of each piston is also monitored by the encoder mounted at the end of each cylinder. FIG. 6 shows typical encoder waveform patterns. Channels A and B have as many as 2,540 cycles per shaft turn which equal to 2,540 counts per shaft turn. By combining channels A & B into a so-called "dual quadrature channel" one can increase the number of counts by a factor of A. For example, 2,500 cycles could offer 10,000 counts per turn. Reference FIG. 7, encoder shaft 113 of encoder 112 is firmly connected to precision ballscrew with zero backlash 111 mounted inside piston rod 110. A 0.5 inch travel of piston rod 110 may mean one full turn of encoder shaft 113, or 10,000 counts for the last example. This means that one count equals a plunger or piston rod travel of 0.00005 inch. The very small increments, in which the plunger travel can be controlled, facilitate a very accurate metering of the desired components of the mix.

If all of the cylinder bores and encoders are identical, the percentage resin quantity pumped is a function of encoder cycles or counts per second. For example, if it is required that the promoter flow equal 0.05% of the resin flow, the cylinder will be programmed for a piston movement of 5 counts per second when the resin is moved at a 10,000 counts per second.

In practice, however, the plunger areas for the resin will be 100× greater than the plunger areas for the promoter and catalyst additions. If the bore diameter of the supply cylinders for promoters and catalyst equals 0.5", we will need a bore diameter of 5" for the resin supply cylinder. The advantage is that a promoter flow equal to 0.05% of the resin flow will now require 500 counts, instead of 5 counts, for each 10,000 cycles of resin flow. This will considerably enhance the accuracy of ratio metering.

At low temperatures, the styrene addition may be as much as 25% of the resin volume. Again for the sake of accuracy, we may want to make the plunger area for the styrene addition ¼ of the resin plunger area, or a bore diameter of 2.5". For a styrene addition equal to 25% of the resin flow by volume, we will have an equal number of counts for resin and styrene. For a styrene addition equal to 5% of the resin flow by volume, that cycle count for the styrene will then be 2,000 counts. For example, assuming a bore diameter of 5", the piston will develop a liquid flow of 19.635 cu.in. per inch of piston travel. Assuming that the piston will move 1" per second, we will have a flow rate of 5.1 GPM. To simplify matters, we endeavor to keep the bore of the supply piston the same as the bore of the hydraulic cylinder when connected by a common piston shaft.

As stated earlier, there will be a curved relationship of temperature versus percentage for all additions to the resin, such as promoters, catalyst and styrene. That information will be entered into the computer, probably in increments of one-tenth of one degree Fahrenheit, or smaller, for temperatures from 35 DF to 120 DF. The values of these increments will be kept small enough so that the changes in value of C or C' (FIG. 5) will be kept insignificantly small. To smoothen out even those very small changes, a pulsation dampener or accumulator can be added to the system. The value C or C' is representative of the liquid flow (GPM) encoder count per second or travel speed of the pistons.

The electronic air temperature sensor 68 (FIG. 3) will continuously inform the computer controller 70 what the air temperature is. Based on the tables and relationships that will have been set up in the computer, the corresponding percentages for all additives will immediately be calculated and transmitted to the corresponding electro-hydraulic servo valves.

For example, with an initial maximum production rate of 5.1 GPM, a net cycle time of 10 seconds and a piston travel rate of 1" per second, we will require a net piston stroke of 10". With a plan to double that production rate at the maximum projected production rate of 10.2 GPM, we will have a piston travel for the resin equal to 2" per second. Assuming a net cycle time of 10 seconds per piston, we will require a net available piston stroke of 20", or assuming a net piston stroke of 10" we will need a net cycle time of 5 seconds per piston.

Whereas the above procedure discussed the accurate metering concept, we will now discuss the ripple-free concept. Without that ripple-free capability, we can not have accurate metering because we will no longer have a constant flow. Each piston will have two strokes: a supply (or up) stroke and a retraction (or down) stroke. When the plunger 62A (FIG. 3) in the bottom hydraulic cylinder retracts, the connecting piston to the plunger in the bottom supply piston or 64A will likewise retract. This creates a vacuum in the chamber if supply piston 51A which permits the fluid (resin, promoter, catalyst or styrene) to enter the chamber through check valve 72 while at the same time it will close check valve 74.

When the plunger 64A in the bottom supply piston 51A retracts, the top plunger 64 is going through the supply stroke. The pressure forces check valve 76 to open while it closes check valve 78 so preventing a back flow of the fluid to the fluid supply 80.

During the net cycle time of 10 seconds, the velocity of the fluid is uniform or uniformly tapering. At the start of the stroke there should be a uniform short tapering (ramping up) from zero to the desired flow (see FIG. 4) (A). Upon termination of the stroke there should be a uniform short tapering (ramping down) from the desired flow down to zero (B). To simplify matters, the ramping up and down speeds (expressed for example as 0.50 sec/volt) should be kept the same for all fluid systems.

Figure 4:
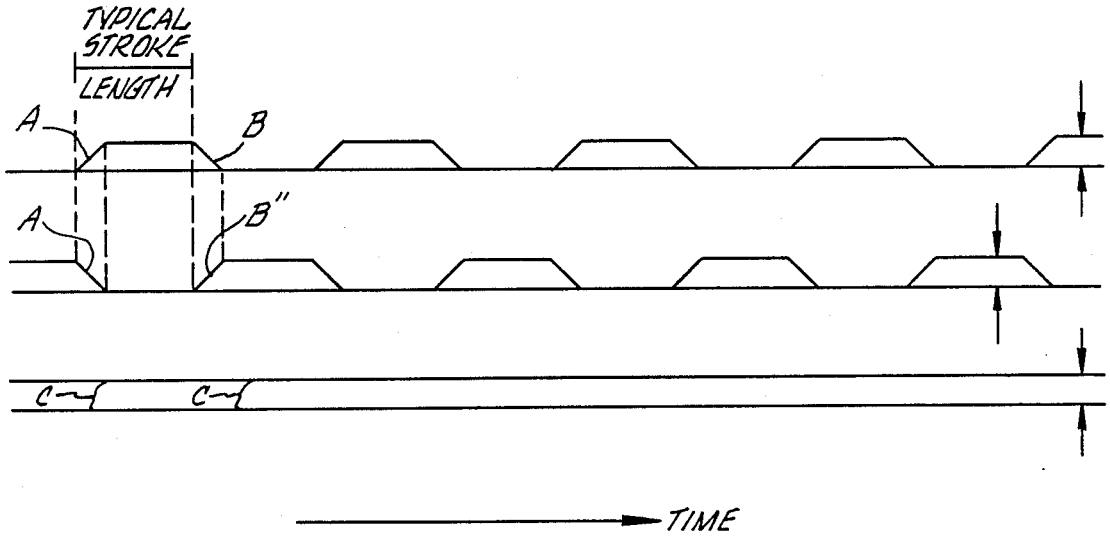
FIG. 4 shows the flow schematic of the coordination between one hydraulic cylinder and the next showing that the area under the curves of the first and second pump in each system is the same and depicting how the flow remains uniform and ripple free i.e. when the velocity (and thus the flow) of the top piston is 0 the velocity (and thus the flow) of the bottom system is maximum and vice versa resulting in uniform flow.

The schematic of this output may be seen on FIG. 4. The computer should be programmed so that the top plungers start to pick up speed, and the graph tapers upwardly (A), while at the same time the bottom assembly starts the taper downwardly (A'). The loss of fluid in the down-stroke is then compensated by the increase in fluid from the up-stroke. The overall stroke length for all fluid components in the preferred embodiment may be kept the same, say 12 inches. All fluid compositions, such as resin, promoters, catalyst and styrene, will then be pumped to a hydraulically driven mixer 82 before the mix enters the nozzle 84.

To control the output of chopped glass, a small hydraulic piston motor 86 will rotate the chopper unit 87. To control the output of that motor, we again use an electro hydraulic servo valve (88) and an encoder (90).

The rotational speed of that chopper unit depends on the desired amount of glass in the laminate. Two factors will play a role: temperature and required glass content in the laminate.

The first relationship is a variable curved relationship of percentage of total fluid flow versus air temperature for a certain given glass content. The total sum of that total fluid flow increases with a lowering air temperature primarily because of the addition of styrene. Should a different glass content be desired, the values in the first relationship will be multiplied in the computer with a multiplication factor, based on the ratio of the new quantity smaller than one.

There is one more factor to control in the spray process, namely the coating thickness which is related to the total amount of liquid and chopped glass fibers sprayed on the wall and the travel speed of the nozzle around the tank wall for a certain given pitch. That travel speed is in turn related to the RPM of the drive wheels 15*a* supporting the revolving tower 15 around the tank wall on which the nozzle 84 is mounted. The first relationship will be a variable curved relationship of the sum of the total liquid flow through the nozzle plus the chopped glass content versus the air temperature. The values in the computer can be based on a certain given spray thickness, say 1/32" per pass. It is determined experimentally what travel speed is needed for a certain given flow through the nozzle to develop that 1/32" thickness in the center of the spray. Alternately, one may be able to control the pitch while leaving the travel speed the same. This mode is the preferred mode.

From this experimental information it is possible to establish in the computer the relationship of the RPM (expressed in encoder cycles per second) of the drive wheel 15*a* versus the air temperature, based on a certain given thickness of spray, say the above-referenced 1/32".

As for the RPM of the chopper gun, it is possible to change the thickness of the spray by multiplying the RPM of the drive wheel by the ratio of the given thickness divided by the new thickness. If the new thickness is double that of the given thickness, then the RPM of the drive wheel 15*a* is one half of what it would have been for the 1/32" thickness. To control the RPM of that drive wheel, we use a hydraulic motor 92 on which is mounted an electro hydraulic servo valve 94 and an encoder 96. This means that the entire mixing and spraying operation including the travel speed of the machine is automatically controlled by the air temperature. The only changes that can readily be made is the input value for the glass content (an unlikely requirement in the field) and the spray thickness, should the default value not be acceptable.

In the event that the glass addition will be changed to the silica sand addition in polymer mortar, a similar type input will be made in the computer to control the sand supply to the nozzle. For example the operator would simply push the G (for glass) or the S (for sand) button to indicate to the computer what material is to be sprayed.

The computer controlled pitch of the nozzle (which will control the overall thickness of the sprayed layer) can also be used for controlling the pitch of the wrapping head (which will control the wire spacing or the amount of wire to be put on the wall) based on the structural requirements of the design and the geometry of wall and dome. Any computer changes to be made in the field, to the mix, spray and wrapping requirements can even be made from a central office via a computer modem.

To further elaborate on how the computer can be used to continuously control the operation of the mixing and spraying unit for the precision construction of the composite tank disclosed herein, once the rotatable tower 15 is erected on the footing and the spray unit 11 is installed in a moveable relation on said tower, power is supplied in the usual manner activating the pumps which provide the operating hydraulic pressure to the central input supply lines which activate the hydraulic cylinders. The hydraulic pressure can also be used to operate the wheels of the rotatable towers 15*a* through hydraulic motor 92. The computers activated temperatures sensor 68 continuously monitors the ambient temperature in the space between the inner membrane 12 and outer-membrane 13. The supply lines from the catalyst, promoter and other reservoirs such as represented by numeral 80 in FIG. 3 are then opened and the computer is activated. The computer has been inputted with a data base which includes data relating to each promoter, catalyst or other chemicals which will be mixed to form the rigidifying material to be sprayed on the inner membrane 12 and which will eventually form the composite wall 18 of the structure. The data base includes the optional ratio or percentage of each chemical which will result in an optimal composite as a function of ambient temperature. As stated previously the percentage of each chemical is very important and varies as a function of said ambient temperature. For example, since it is typically easier for material to react at higher temperature the percentage of promoter and catalyst decreases as the temperature increases. All of this is included in the computer data base and the computer utilizes the information stored in this data base to calculate the optimal velocity of each cylinder and each pump system to obtain a constant volumetric pumping rate of each chemical to arrive at an optimal mix of all chemicals at any given temperature. For example, at a temperature of 70° the computer can easily compute, based on the composition of the promoters, catalysts, and other chemicals what the optimal mix of these chemicals is to be. The computer then calculates the velocity of each piston required to pump the optimal ratio of chemicals and in turn calculate the amount of oil pressure to be provided to each cylinder to accomplish this goal. The computer then sends the appropriate signal to the servo valves of each cylinder to set the velocity and therefore the volume pumped by each piston.

The operator can also determine the amount of rigidifying material which is to be sprayed on each pass of the spraying unit as it revolves around the tank. The computer is inputted with information regarding the speed the spraying unit revolves around the tank as well as the vertical placement of each pass. The computer's data base also includes information relating to the optimal amount of chopped material from chopper 87 which is to be added to the stream from the spraying unit 84. The computer automatically computes and corollates the amount of chopped material sprayed in relation to the velocity of the spraying unit on the tower as it proceeds around the tank. Of course, the faster the tower rotates the thinner the layer at any given chopper operation. Accordingly, to keep a uniform proportion of chopped glass on the surface sprayed, it is necessary to increase the rotation of the chopper as the rotation of the wheels increase to arrive at a uniform deposit of chopped glass or other material on the membrane. The computer data base can also contain an optimal proportion of chopped material in relation to a given volume of rigidifying materials sprayed and can coordinate the proportion of the two superimposed sprays accordingly. The computer can also determine the volume of material sprayed as a function of time as well as the volume of chopped glass sprayed as a function of time and indeed adjust one in relation to the other. It can continuously compute the volume of materials sprayed, the velocity of the rotating tower, and thus the velocity of the spray unit in a horizontal direction, it can position and regulate the velocity of the sprayer in a vertical position, the RPM of the chopper, the RPM of the wheels and the travel speed of each piston in each pumping unit to regulate and adjust the ratio of chemicals to arrive at an optimal mix of rigidifying material to be sprayed on the walls of tank.

Thus, an improved pumping and metering system for construction of cylindrical or domed structures is disclosed. While the embodiments and applications of this invention have been shown and described, and while the best mode contemplated at the present time by the inventor has been described, it should be apparent to those skilled in the art that many more modification are possible without departing from the inventive concepts therein. Both product and process claims have been included and in the process claims it is understood that the sequence some of the claims can vary and still be within the scope of this invention. The invention therefore can be expanded, and is not to be restricted except as defined in the appended claims and reasonable equivalence departing therefrom.

I claim:

1. A pump system for pumping liquids from supply cylinders through an outlet, comprised of a plurality of pump assemblies, each pump assembly having a first means for pumping fluids, a second means for pumping fluids, and a control means for continuously monitoring and controlling the rate of pumping of the first and second means so that the combined flow is substantially constant and substantially ripple-free;

wherein each means for pumping includes a hydraulic cylinder having a hydraulic piston, said hydraulic piston being connected to a supply piston in a supply cylinder, said supply cylinder having at least one input check valve and at least one output check valve.

2. The ripple-free pump assembly of claim 1 wherein the output of each pump assembly communicates with a mixing means leading to an outlet of said mixing means and resulting in a first stream from said outlet.

3. The pump assembly of claim 2 wherein the apparatus also includes a chopper feed mechanism directing chopped fiber in a second stream, the second stream being substantially superimposed on the first stream.

4. A pump assembly comprising:

a. first and second means for pumping, b. a means for supplying pressurized fluid to said first and second means for pumping, c. a control means for continuously monitoring and controlling the rate of pumping of the first and second means to ensure substantially ripple-free flow, d. a supply reservoir and means for supplying the material to be pumped under pressure to said first and second means for pumping, e. said first and second means for pumping comprising pistons in hydraulic cylinders, said hydraulic cylinders communicating with said pressurized source of fluid for driving said pistons.

5. The apparatus of claim 4 wherein the control means for continuously monitoring and controlling the rate of pumping of the first and second means for pumping include an encoder positioned to sense the rate of pumping, a computer receiving the output of said encoder, and a servo valve communicating with said first and second means for pumping and said computer, and operatively coupled with said means for pumping.

6. The apparatus of claim 4 wherein said means for continuously monitoring and controlling the rate of pumping is at least in part accomplished by a computer.

7. The apparatus of claim 4 including at least one means for sensing ambient conditions and utilizing the information sensed to further control the rate of pumping of the first and second means for pumping.

8. The pump assembly of claim 4, in which said first and second means for pumping are synchronized so that the first piston starts to move from a position of zero velocity when the second piston declines to approach a position of zero velocity and so that the first piston reaches maximum velocity when the second piston reaches zero velocity, resulting in continuous substantial ripple-free combined flow.

9. An apparatus utilizing a plurality of pump assemblies for use in the construction of composite tanks for applying material to a surface through an outlet, each pump assembly comprising:

i. a pressurized input supply line and a return supply line;

ii. a first hydraulic cylinder having a first hydraulic piston and having a first control means controlling the flow to one side of the first hydraulic piston from said pressurized input supply line and controlling the flow from the other side of the first hydraulic piston to a return supply line, iii. a first supply cylinder having a first supply piston connected to said first hydraulic piston, said first supply cylinder having at least one inlet check valve and at least one outlet check valve, iv. a second hydraulic cylinder having a second hydraulic piston and having a second control means controlling the flow to one side of the second hydraulic piston from a central pressurized supply line and controlling the flow from the other side of the second hydraulic piston to a return supply line, v. a second supply cylinder having a second supply piston, connected to the second hydraulic piston, said second supply cylinder having at least one inlet check valve and at least one outlet check valve, vi. means for independently sensing and controlling the movement of the first and second hydraulic pistons so that the first piston starts to move from a position of zero velocity when the second piston starts to decline to a position of zero velocity and when the first piston reaches maximum velocity, the second piston reaches zero velocity, resulting in a continuous substantial ripple-free combined flow from the supply cylinders;

wherein the means for independently sensing and controlling the movement of the first and second hydraulic pistons include an encoder positioned to sense piston location and velocity, a computer receiving the output of said encoder and a servo valve communicating with said first and second hydraulic pistons and said computer and operatively coupled with said pistons.

10. The apparatus of claim 9 including at least one means for sensing ambient conditions and utilizing the information sensed to further control the position and velocity of the first and second hydraulic pistons.

11. A pump system for pumping liquids from supply cylinders through an outlet, comprised of a plurality of pump assemblies, each pump assembly having a first means for pumping fluids, a second means for pumping fluids, and a control means for continuously monitoring and controlling the rate of pumping of the first and second means so that the combined flow is substantially constant and substantially ripple-free;

wherein the control means for continuously monitoring and controlling the rate of pumping of the first and second means for pumping fluids include an encoder positioned to sense the rate of pumping, a computer receiving the output of said encoder, and a servo valve communicating with said first and second means for pumping and said computer, and operatively coupled with said means for pumping.

12. The apparatus of claim 11 including at least one means for sensing ambient conditions and utilizing the information sensed to further control the position and velocity of the first and second hydraulic pistons.

13. An automated spray system for accurately mixing and spraying composite for use in the construction of fiberglass tanks comprising:

a. at least one first means for pumping a resin at a continuously monitored and controlled rate, b. at least one additional means for pumping additives at a continuously monitored and controlled rate, c. said first and additional means communicating with a means for mixing, d. means for creating a continuous first stream of mixed fluid from said means for mixing, e. control means for continuously monitoring and controlling the rate of pumping of the first and additional means thus controlling the rate of flow from said first and additional means;

wherein the control means for continuously monitoring and controlling the rate of pumping of the first and second means for pumping include an encoder positioned to sense the rate of pumping, a computer receiving the output of said encoder, and a servo valve communicating with said first and second means for pumping and said computer, and operatively coupled with said means for pumping.

14. An automated spray system for composite tanks comprising:

a. a support structure able to be rotated around the perimeter of said tank, b. an automated spray unit adjustably mounted on said support structures, c. said spray unit comprising a plurality of pump assemblies communicates with a common outlet for substantially ripple free automated spraying of composite, d. at least one material reservoir communicating with each pump assembly, e. a control means for continuously monitoring and controlling the rate of pumping of each pump assembly;

wherein the control means for continuously monitoring and controlling the rate of pumping of the pump assemblies include an encoder positioned to sense piston location and velocity, a computer receiving the output of said encoder, and a servo valve communicating with said pump assemblies and said computer, and operatively coupled with said pump assemblies.

15. An apparatus utilizing a plurality of pump assemblies for use in the construction of composite tanks for applying a material to a surface through an outlet, each pump assembly comprising:

i. a pressurized input supply line and a return supply line, ii. a first hydraulic cylinder having a first hydraulic piston and having a first control means controlling the flow to one side of the first hydraulic piston from said pressurized input supply line and controlling the flow from the other side of the first hydraulic piston to a return supply line, iii. a first supply cylinder having a first supply piston connected to said first hydraulic piston, said first supply cylinder having at least one inlet check valve and at least one outlet check valve, iv. a second hydraulic cylinder having a second hydraulic piston and having a second control means controlling the flow to one side of the second hydraulic piston from a central pressurized supply line and controlling the flow from the other side of the second hydraulic piston to a return supply line, v. a second supply cylinder having a second supply piston, connected to the second hydraulic piston, said second supply cylinder having at least one inlet check valve and at least one outlet check valve, vi. first means for independently sensing and controlling the position of said first and second hydraulic piston, vii. second means for independently sensing and controlling the velocity of each first and second hydraulic piston, viii. said first and second means regulating and controlling the desired combined flow from the supply cylinders;

wherein the means for independently sensing and controlling the movement of the pistons include an encoder positioned to sense piston location and velocity, a computer receiving the output of said encoder and a servo valve communicating with said pistons and said computer and operatively coupled with said pistons.

16. The apparatus of claim 15 including at least one means for sensing ambient conditions and utilizing the information sensed to further control the position and velocity of the first and second hydraulic pistons.

17. A pump system for pumping liquids from supply cylinders through an outlet, comprised of a plurality of pump assemblies, each pump assembly having a first piston means for pumping fluids, a second piston means for pumping fluids and control means to control piston position and velocity as to have combined ripple free continuous flow;

wherein the control means to control the piston position and velocity includes an encoder positioned to sense piston location and velocity, a computer receiving the output of said encoder, and a servo valve communicating with said first and second piston means and said computer, and operatively coupled with said piston means.

18. The apparatus of claim 17 including at least one means for sensing ambient conditions and utilizing the information sensed to further control the movement of the first and second piston means.

19. A pump assembly comprising:

a. a first and second means for pumping, b. a means for supplying pressurized fluid to said first and second means for pumping;

c. a control means for continuously controlling the first and second means for pumping to ensure substantially monitored and controlled flow;

d. a supply reservoir for supplying the material to be pumped and in communication with said first and second means for pumping;

e. said first and second means for pumping comprising a piston in a hydraulic cylinder, said hydraulic cylinder communicating with said pressurized source of fluid for driving said piston;

wherein said control means to continuously control the first and second means for pumping includes an encoder positioned to sense the rate of flow from the first and second means for pumping, a computer receiving the output of said encoder, and a servo valve communicating with said first and second means for pumping and said computer, and operatively coupled with said first and second means for pumping.

20. An automated spray system for accurately mixing and spraying composite for use in the construction of fiberglass tanks comprising:

a. at least one first means for pumping a resin at a continuously monitored and controlled rate, b. at lest one additional means for pumping additives at a continuously monitored and controlled rate, c. said first and additional means communicating with a means for mixing, d. means for creating a continuous first stream of mixed fluid from said means for mixing, e. control means for coordinating the rate of flow from said first and additional means;

wherein the means for coordinating the rate of flow includes an encoder positioned to sense the rate of flow from the first and second means for pumping, a computer receiving the output of said encoder, and a servo valve communicating with said first and second means for pumping and said computer, and operatively coupled with said first and second means for pumping.

* * * * *